US005716225A

United States Patent [19]

Stringer et al.

[11] Patent Number: 5,716,225

[45] Date of Patent: Feb. 10, 1998

[54] ELECTRICAL ASSEMBLY WITH DUAL VOLTAGE ELECTRICAL CONNECTOR BETWEEN BALLAST AND HIGH INTENSITY DISCHARGE LAMP FIXTURE

[75] Inventors: Ralph S. Stringer, Torrance; Horace L. Green, Lynwood, both of Calif.

[73] Assignee: Hubbell Incorporated, Orange, Conn.

[21] Appl. No.: 725,463

[22] Filed: Oct. 4, 1996

Related U.S. Application Data

[63] Continuation-in-part of Ser. No. 314,787, Sep. 29, 1994.

[51] Int. Cl.[6] ..... H01R 27/00

[52] U.S. Cl. ..... 439/221; 439/956

[58] Field of Search ..... 439/217, 218, 439/221, 956, 222, 357, 358; 315/276, 278, 282

[56] References Cited

U.S. PATENT DOCUMENTS

| | | | |
|---|---|---|---|
| 1,870,762 | 8/1932 | Winter | 439/221 |
| 3,139,492 | 6/1964 | Cage, Jr. | 200/11 |
| 3,210,578 | 10/1965 | Sherer | 310/71 |
| 3,231,767 | 1/1966 | Powell | 439/221 X |
| 3,983,407 | 9/1976 | Shott | 307/146 |
| 4,649,332 | 3/1987 | Bell | 439/222 X |
| 4,671,600 | 6/1987 | Sawai et al. | 439/221 |
| 4,781,610 | 11/1988 | Mercer | 439/217 |
| 4,916,363 | 4/1990 | Burton et al. | 315/276 OR |
| 5,001,401 | 3/1991 | Costa et al. | 315/278 OR |
| 5,017,818 | 5/1991 | Dohogne | 310/71 |

*Primary Examiner*—Neil Abrams
*Assistant Examiner*—Daniel Wittels
*Attorney, Agent, or Firm*—Jerry M. Presson; David L. Tarnoff

[57] ABSTRACT

An electrical assembly for selectively supplying either 120 volts or 227 volts from a junction box to a high intensity discharge lamp fixture via a dual voltage ballast and a dual voltage electrical connector. The dual voltage electrical connector has dual operation capacity with input voltages of either 120 or 277 volts. The connector comprises a female connector having nine bores extending therethrough with female terminals fixedly coupled within four of the bores, and a male connector having nine bores extending therethrough with contact pins extending outwardly from four of these bores. When the connectors are coupled together in their first orientation, the male contact pin which conducts 120 volts of electricity engages the female terminal connected to a line wire. When the male and female connectors are manually rotated 180° relative to one another into their second orientation, a different pin, which conducts 277 volts, engages the line wire terminal. A latching device is fixedly coupled to the two connectors for releasably coupling the two connectors together.

12 Claims, 4 Drawing Sheets

ELECTRICAL ASSEMBLY WITH DUAL VOLTAGE ELECTRICAL CONNECTOR BETWEEN BALLAST AND HIGH INTENSITY DISCHARGE LAMP FIXTURE

CONTINUING APPLICATION

This application is a continuation-in-part application of U.S. patent application Ser. No. 08/314,787, filed Sep. 29, 1994.

FIELD OF THE INVENTION

The invention relates to an electrical assembly with mating electrical connectors with dual voltage capacity. More particularly, the invention relates to a first connector having a female line terminal fixedly coupled thereto, and a second connector having a 120 volt male conductor pin and a 277 volt male conductor pin fixedly coupled thereto. The first and second connectors can be relatively pivoted through 180° between two orientations. In the first orientation, the 120 volt male pin contacts the female line terminal, and in the second orientation, the 277 volt male pin contacts the female line terminal.

BACKGROUND OF THE INVENTION

Mating electrical connectors having dual operation capacity are known. However, none is known to exist for use with High Intensity Discharge (HID) lamp fixtures.

Commonly, buildings using HID lamp fixtures are upgraded from 120 volts to 277 volts. In the past, this entailed rewiring the junction box before the upgrade could be completed. This process was both time consuming and costly for electricians.

Examples of some prior electrical connectors having dual operation capacity are disclosed in the following patents: U.S. Pat. No. 1,870,762 to Winter; U.S. Pat. No. 3,983,407 to Shott; U.S. Pat. No. 4,781,610 to Mercer; and U.S. Pat. No. 5,017,818 to Dohogne.

SUMMARY OF THE INVENTION

Accordingly, a primary object of the invention is to provide a ballast assembly having an electrical connector for use with HID lamp fixtures that has dual operation capacity.

Another object of the invention is to provide a dual voltage electrical connector for use with HID lamp fixtures that saves an electrician installation time by eliminating the need to rewire junction boxes when upgrading buildings from 120 to 277 volt capacity.

Another object of the invention is to provide a dual voltage electrical connector for use with HID lamp fixtures that allows the fixture to be delivered hard-wired.

A further object of the invention is to provide a dual voltage electrical connector for use with HID lamp fixtures that is easily changeable from 120 volt capacity to 277 volt capacity.

A further object of the invention is to provide an electrical connector that is relatively inexpensive to manufacture.

The foregoing objects are basically attained by providing An electrical assembly, comprising: a lamp fixture with a pair of lamp terminals; a dual voltage ballast electrically coupled to the lamp fixture, the ballast having a high voltage terminal, a low voltage terminal and a lamp wire terminal; a first connector having first and second opposing ends with a plurality of first electrical terminals, one of the first terminals being electrically connected to a hot conductor of a power cable by a line wire, another of the first terminals being electrically connected to a neutral conductor of a power cable by a common wire and another of the first terminals being electrically connected to one of the lamp terminals of the lamp fixture by a first lamp wire; and a second connector having a main body with first and second opposing faces with a plurality of second electrical terminals, one of the second terminals being electrically connected to the low voltage terminal of the ballast by a low input voltage wire, another of the second terminals being electrically connected to the high voltage terminal of the ballast by a high input voltage wire and another of the second terminals being electrically connected to the lamp wire terminal of the ballast by a second lamp wire, the first and second connectors adapted to be positioned in first and second orientations, the second terminal with the low input voltage wire being electrically coupled to the first terminal with the line wire when the first and second connectors are in the first orientation, and the second terminal with the high input voltage wire being electrically coupled to the first terminal with the line wire when the first and second connectors are in the second orientation, the first and second connectors being rotatable relative to one another through 180° to move between the first and second orientations.

Other objects, advantages and salient features of the invention will become apparent from the following detailed description which, taken in conjunction with the annexed drawings, discloses the preferred embodiment of the invention.

BRIEF DESCRIPTION OF THE DRAWINGS

Referring now to the drawings which form part of this original disclosure.

DETAILED DESCRIPTION OF THE INVENTION

Figure 1:
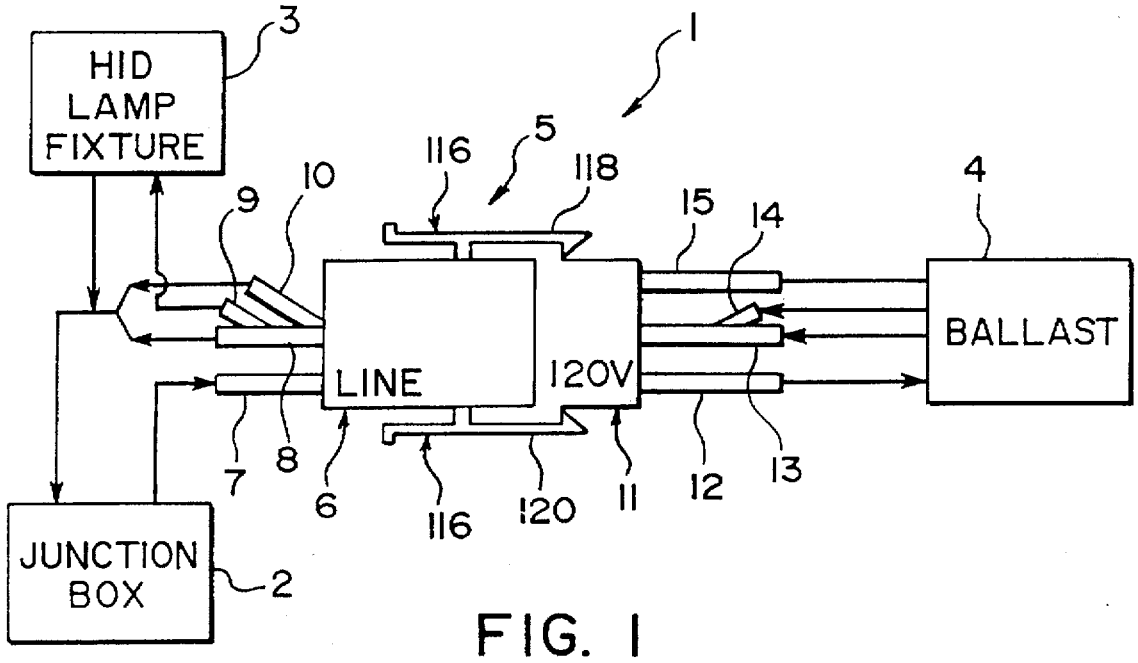
FIG. 1 is a diagrammatic view of a ballast assembly having a dual electrical connector electrically coupling the 120 volt terminals of a dual voltage ballast to a high intensity discharge lamp fixture in accordance with the present invention.
Figure 2:
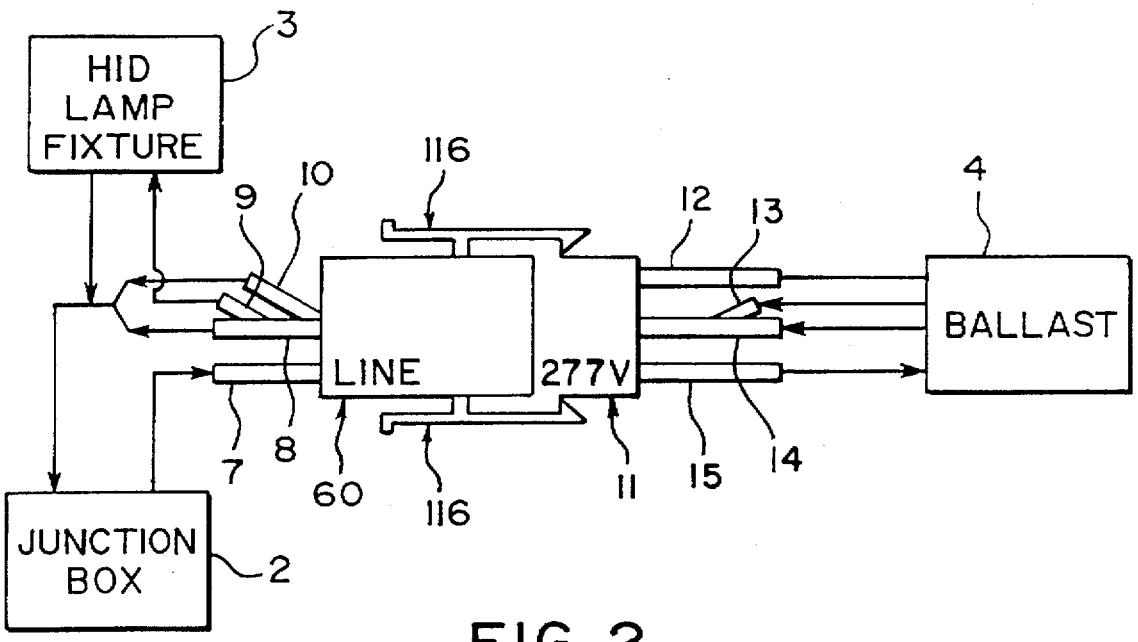
FIG. 2 is a diagrammatic view of the ballast assembly illustrated in FIG. 1, but with the dual electrical connector rotated 180° for electrically coupling the 277 volt terminals of the dual voltage ballast to the high intensity discharge lamp fixture.

As seen in FIGS. 1 and 2, an electrical assembly 1 is illustrated in accordance with the present invention for selectively conducting or supplying either 120 volts or 227 volts from a junction box 2 to a high intensity discharge lamp fixture 3 via a dual voltage ballast 4 and a dual voltage electrical connector 5. The dual voltage electrical connector 5 in accordance with the present invention comprises a first or female connector 6 with four conductors or wires 7, 8, 9 and 10 fixedly coupled thereto and a second or male connector 11 also having four conductors or wires 12, 13, 14 and 15 fixedly coupled thereto.

Junction box 2, lamp fixture 3 and ballast 4 are conventional parts which are well known in the art. Thus, junction box 2, lamp fixture 3 and ballast 4 will not be discussed or illustrated in detail herein.

First connector 6 has a main body 19 with first and second opposing ends 20 and 22, and includes a first set of apertures or bores 24 which extend through the first connector 6, and a first set of a plurality of female terminals or tubular contacts 25–28 fixedly coupled within several of the apertures or bores 24. One of the terminals 28 is connected to a line wire 7 which in turn is electrically coupled to a hot wire in junction box 2.

The second connector 11 has a main body 30 with first and second opposing faces 32 and 34, and includes a second set of apertures or bores 36 extending through the main body 30 and a second set of a plurality of male terminals or contact pins 38–41 fixedly coupled within and extending outwardly from several of the apertures or bores 36. One of the pins 41 is connected to a low input voltage lead wire 12 which in turn is electrically coupled to the low voltage input terminal of ballast 4 and another of the pins 38 is connected to a high input voltage lead wire 15 which in turn is electrically coupled to the high voltage input terminal of ballast 4.

Figure 3:
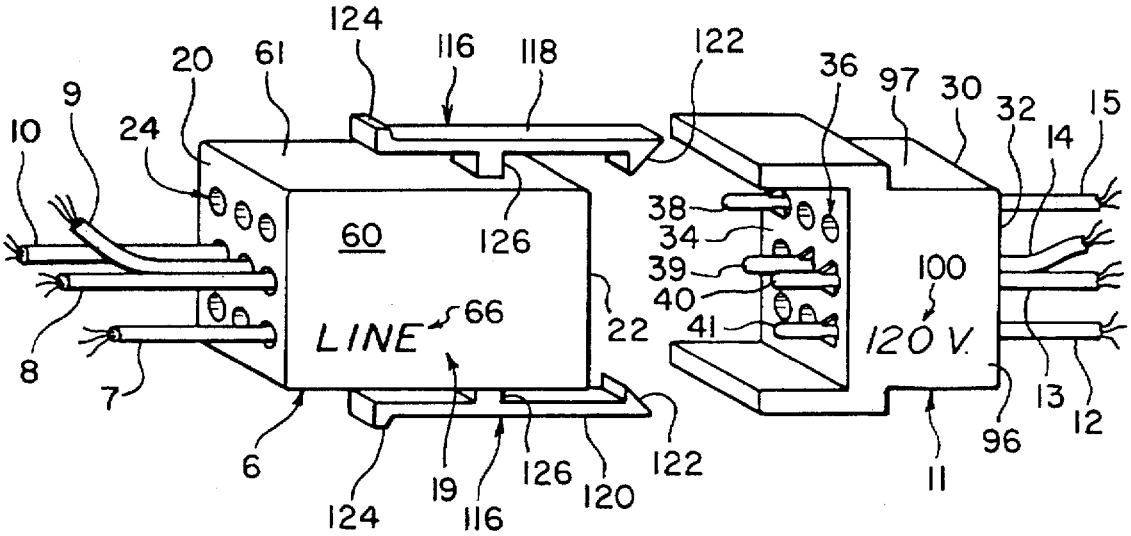
FIG. 3 is an exploded perspective view of the first and second connectors in accordance with the present invention with the second connector in its first orientation for supplying 120 volts from the dual voltage ballast to the high intensity discharge lamp fixture and before coupling the connectors together.
Figure 4:
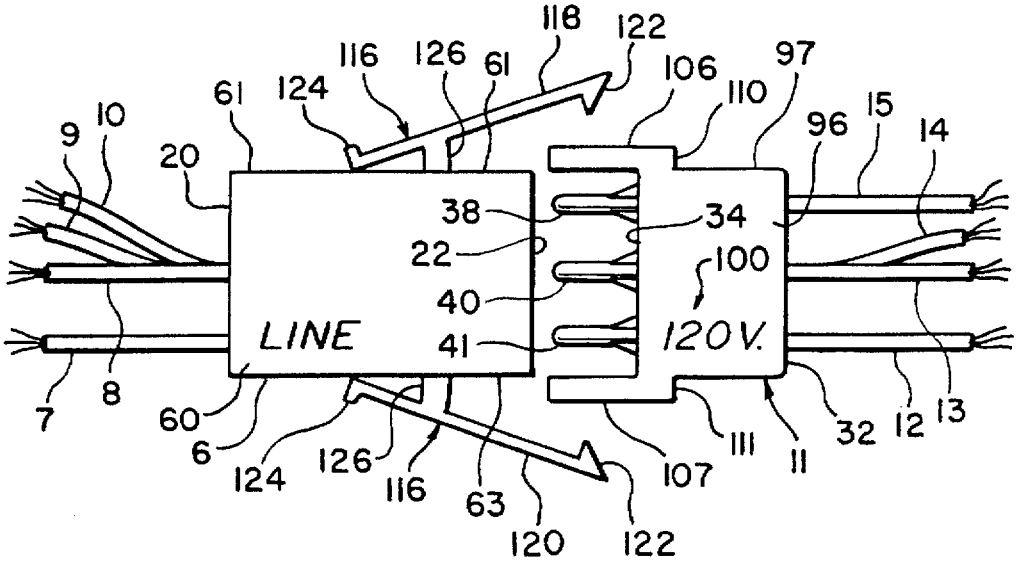
FIG. 4 is an exploded side elevational view of the connectors of FIG. 3 as the connectors are being coupled together.
Figure 6:
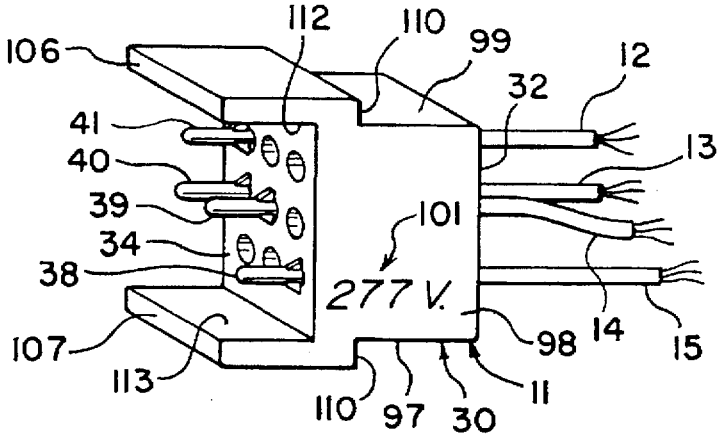
FIG. 6 is a perspective of the second connector of FIGS. 3–5 after being pivoted 180° into its second orientation for supplying 120 volts from the dual voltage ballast to the high intensity discharge lamp fixture as illustrated in FIG. 2.
Figure 7:
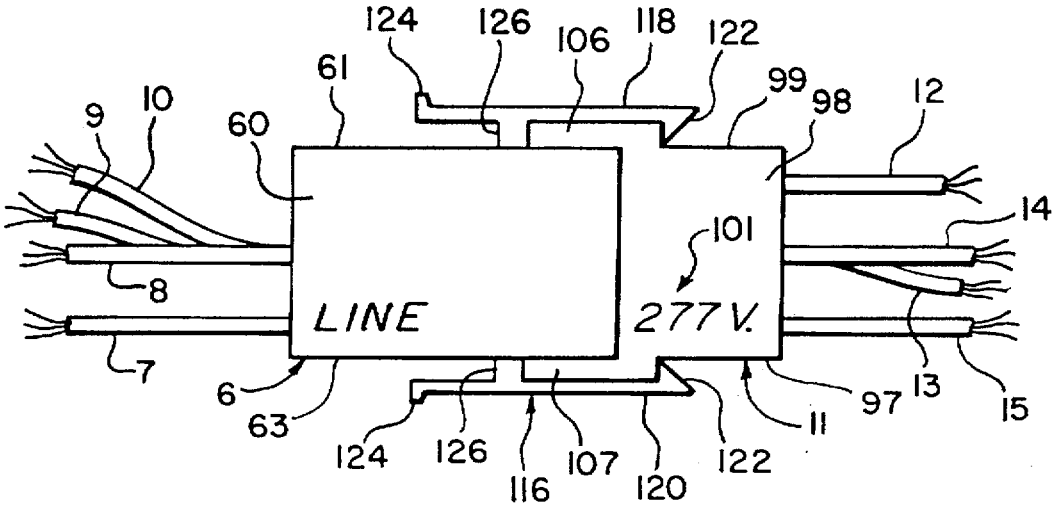
FIG. 7 is an enlarged side elevational view of the dual voltage electrical connector illustrated in FIG. 2 such that the second connector is coupled to the first connector in its second orientation for supplying 277 volts from the dual voltage ballast to the high intensity discharge lamp fixture.
Figure 8:
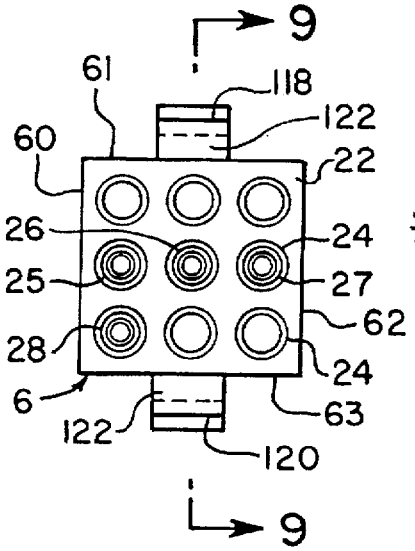
FIG. 8 is a front end view of the first connector of FIGS. 1–7.

The second connector 11 has first and second orientations and relative to the first connector 6 for selectively conducting or supplying either 120 volts or 277 volts to high intensity discharge lamp fixture 3. In the first orientation as seen in FIGS. 1, 3 and 4, the low input voltage pin 41 is inserted within the line terminal 28 (as seen in FIG. 8) to establish a low voltage electrical path between lamp fixture 3 and ballast 4. In the second orientation as seen in FIGS. 2, 6 and 7, the high input voltage pin 38 is inserted within the line terminal 28 (as seen in FIG. 8) to establish a high voltage electrical path between lamp fixture 3 and ballast 4. The first and second connectors 6 and 11 are relatively rotated 180° about their longitudinal axes to move between the first and second orientations.

The conductors or wires 7–10 and 12–15 are insulated wires which are inserted into and coupled within the first and second sets of apertures 24 and 36. Wires 7–10 are connected at one end to first connector 6, as seen in FIGS. 1–5 and 7, and extend outwardly therefrom. Wires 8 and 10 are standard white No. 18GA wires, and are electrically connected to each other and then are electrically connected to the neutral conductor of a power cable in the junction box 2 and a terminal on the HID lamp fixture 3 in a conventional manner. Wire 9 is also a standard white No. 18GA wire, and is connected to HID lamp fixture 3. Wire 7 is a standard black No. 18GA wire, and is electrically connected to the hot conductor line of a power cable in the junction box 2.

Wires 12–15 are connected at one end to second connector 11 and extend outwardly therefrom, as seen in FIGS. 1–7. At the other end, wires 12–15 are connected to the terminals of ballast 4 in a conventional manner. Wire 15 is a standard black No. 18GA wire, i.e., a hot wire, which conducts 277 volts of electricity. Wire 14 is a white No. 18GA, and is the lamp wire. Wire 13 is a white No. 18GA wire and is the common wire. Wire 12 is a black No. 18GA wire, i.e., a hot wire, which conducts 120 volts of electricity.

Figure 9:
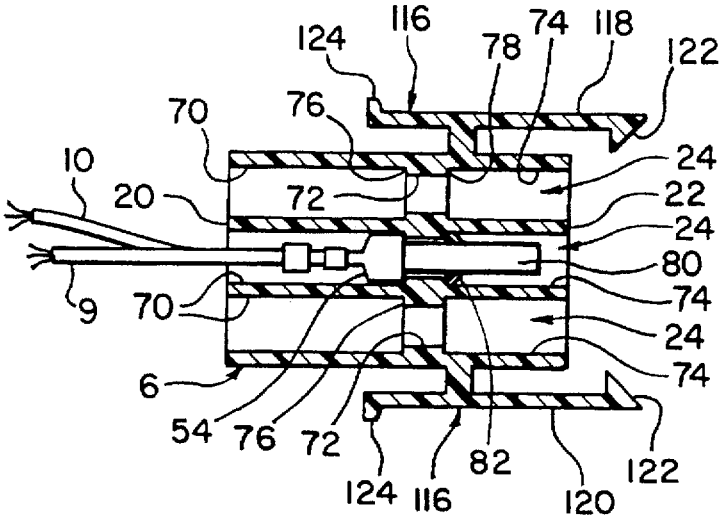
FIG. 9 is a side elevational view of the first connector in cross section taken along line 9—9 of FIG. 8.

As seen in FIGS. 3, 8 and 9, the first set of apertures or bores 24 extend through the first connector 6, from the first opposing end 20, through the connector 6, to the second opposing end 22. Preferably, there are nine apertures or bores 24 which form a matrix or pattern at the second end 22 arranged in three evenly spaced rows, each row having three positions totalling nine positions.

The first or female connector 6, as seen in FIGS. 1–5, 7 and 8, is molded from an insulating material, preferably rigid plastic such as nylon. The first connector 6 forms a rectangular cube having planar first and second opposing ends 20 and 22 and four planar sides 60–63. As seen in FIGS. 1–5, the first end 20 receives the wires 12–15, and the second end 22 engages the second opposing face 34 of the second connector 11. The first side 60 has raised indicia 66 indicating that the terminal immediately adjacent the indicia 66 is connected to the line wire 7. Thus, the indicia 66 preferably spells out the word "LINE".

As seen in FIGS. 8 and 9, the apertures or bore 24 are all substantially identical, having a circular cross section with two diameters, the first diameter being larger than the second. In particular, each of the apertures or bores 24 has a first large diameter 70 beginning at first end 20, and extend through just over half the length of first connector 6, where the diameter changes to the small diameter section 72 for a relatively short distance. Thereafter, the apertures or bores 24 change back to a second large diameter section 74 and extend through the main body to the second end 22 of connector 6. A stop 76 is formed where the first large diameter section 70 becomes the small diameter section 72. A shoulder 78 is formed where the small diameter section 72 becomes the second large diameter section 74.

As seen in FIGS. 6 and 8, each of the terminals 25–28 is fixedly coupled within one of the apertures or bores 24. Line terminal 28 is coupled at the seventh position. The other terminals 25–27 are coupled at the fourth, fifth and sixth positions, respectively.

As seen in FIGS. 8 and 9, the terminals 25–28 are formed of conductive metal, and are fixedly coupled, respectively, to wires 7–10 by connecting bands 54. The terminals 25–28 have a hollow tubular body 80, with legs 82 extending radially outwardly from the body 80. The legs 82 are resiliently coupled near the end of the terminal adjacent the wires or conductors 7–10.

As the terminals 25–28 are inserted into the apertures or bores 24 from first end 20, the legs 82 resiliently collapse along their bodies 80 when the terminals 25–28 pass through the small diameter sections 72 of bores 24. Once the terminals 25–28 reach the second large diameter sections 74 of bores 24, the legs 82 resiliently spring outwardly and engage the shoulders 78 of bores 24. Connecting bands 54 engage stops 76 of bores 24, thereby fixedly coupling the terminals 25–28 within the apertures or bores 24.

As seen in FIGS. 1–5 and 7, the second or male connector 11 is also molded from an insulating material, preferably a rigid plastic such as nylon. The main body 30 forms a rectangular cube having substantially the same length and width dimensions as first connector 6. The main body 30 has two planar opposing faces 32 and 34, and four planar sides 96–99.

The first face 32 receives conductors or wires 12–15, and the second face 34 engages the second end 22 of the first connector 6 when connectors 6 and 11 are coupled together, as seen in FIGS. 1, 2, 5 and 7.

The first and third sides 96 and 98 have raised indicia 100 and 102 thereon, indicating high and low voltage, respectively. As seen in FIGS. 1 and 3–5, the low voltage indicia 100, i.e., "120 V.", is located on the first side 96 immediately adjacent and aligned with the low voltage pin 41. As seen in FIGS. 6 and 7, the high voltage indicia 101, i.e., "277 V.", is located on the third side 98 immediately adjacent and aligned with the high voltage pin 38.

Figure 11:
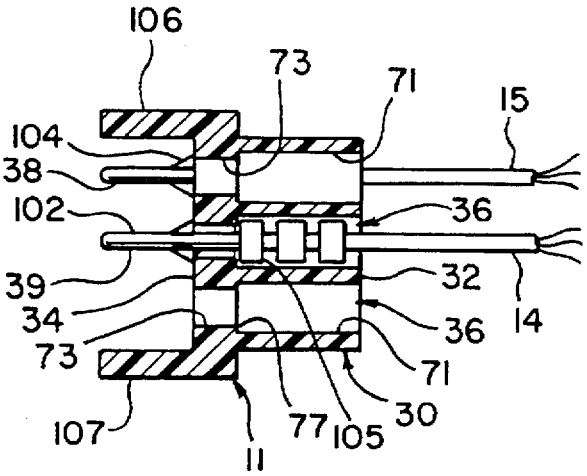
FIG. 11 is a side elevational view of the second connector in cross section taken along line 11—11 of FIG. 9.

As seen in FIGS. 9 and 11, the second set of apertures or bores 36 extend from the first face 32 through the main body 30 to the second opposing face 34. The second set of apertures or bores 36 are arranged exactly like the first set of apertures or bores 24 within the first connector 6, and thus form a matrix or pattern on the second face 34 having nine apertures arranged in three evenly spaced rows, each row having three positions totalling nine positions.

As seen in FIG. 11, the second set of apertures or bores 36 also have a circular cross section with a large diameter section 71 and a small diameter section 73. The large diameter section 71 extends from the first face 32 through approximately two-thirds of the main body 30 where it changes to the small diameter section 73. The apertures 36 having small diameter section 73 extend through the rest of the main body 30 to second opposing face 34. At the point where the large diameter section 71 changes to the small diameter section 73, an annular stop 77 is formed.

As seen in FIGS. 3, 9 and 11, contact pins 38–41 are fixedly coupled to wires 12–15 by connecting bands 105, and extend outwardly from the second set of apertures or bores 36 at the first, fifth, sixth and ninth positions. The low voltage contact pin 41 is fixedly coupled to the low voltage wire 12 at the ninth position. The high voltage contact pin 38 is fixedly coupled to the high voltage wire 15 at the first position. Pins 39 and 40 are fixedly coupled to wires 44 and 45 at the fifth and sixth positions, respectively.

As seen in FIG. 11, the conductor pins 38–41 are formed of conductive metal and have a substantially tubular, hollow body 102 with legs 104 extending radially outwardly from one end of the hollow body 102 most adjacent the conductors or wires 12–15. The body 102 has a tapered tip 103 at the other end. The legs 104 are resiliently coupled to the body 102.

As the pins 38–41 are inserted into the apertures 36, the legs 104 resiliently collapse along the body 102 when the pins 38–41 pass through the small diameter section 73. The legs 104 resiliently spring outwardly and engage second face 34 upon emerging from the small diameter section 73. Connecting bands 105 engage stop 77, thereby fixedly coupling the pins 38–41 to second connector 14.

Figure 5:
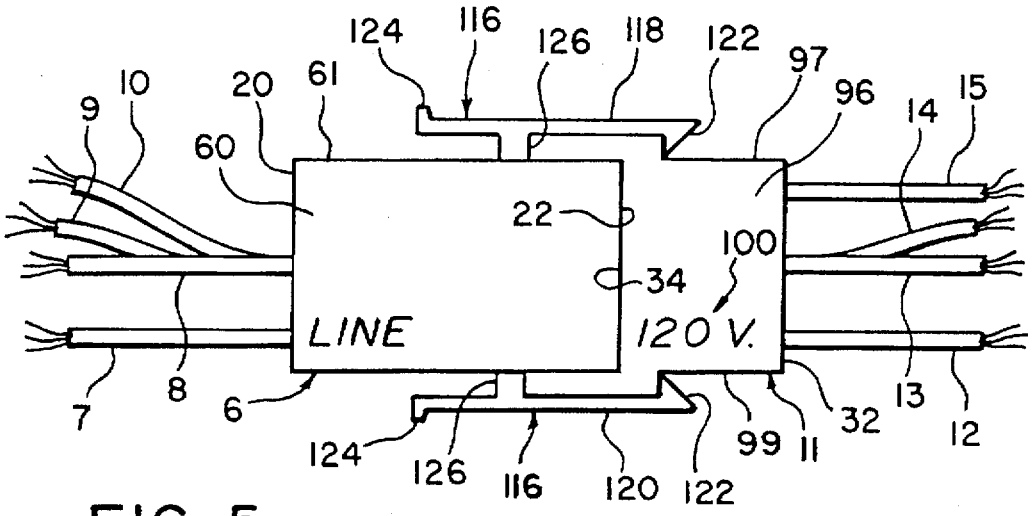
FIG. 5 is a side elevational view of the connectors of FIGS. 3 and 4 after being coupled together.

As seen in FIGS. 4 and 5, two arms 106 and 107 extend outwardly from the end of the second and fourth sides 97 and 99 adjacent the second face 34. The arms are parallel with the contact pins 38–41. The end of the arms 106 and 107 are integrally coupled to the second and fourth sides 97 and 99 and form two shoulders 110. Each arm 106 and 107 has a inner engaging face 112 and 113 which engages the second and fourth sides 61 and 63 of the first connector 6 when the connectors 6 and 11 are coupled together.

The second connector 11 has first and second orientations relative to the first connector 6. As seen in FIG. 3, the second connector 11 is in the first orientation. As seen in FIG. 6, the second connector 11 is in the second orientation. The second connector 11 can be rotated 180° between the first and second orientations. Therefore, the contact pins 38–41 extend outwardly from the second set of apertures or bores 36 at the first, fifth, sixth and ninth positions, respectively, when the second connector 11 is in the first orientation. The pins 38–41 extend outwardly from positions representing inversions of the first, fifth, sixth and ninth positions, respectively, when the second connector 11 is in the second orientation.

Specifically, the 120 volt or low voltage pin 41 is coupled to the second connector 11 at the ninth position when in the first orientation, and the 277 volt or high voltage pin 38 is coupled to the second connector 11 at the first position when in the first orientation. When the second connector 11 is pivoted 180°, the low voltage contact pin 41 is coupled to the second connector 11 at the inverse of the first position, and the high voltage pin 38 is coupled to the second connector 11 at the inverse of the ninth position.

The first and second connectors 6 and 11 can be securely coupled together by latching mechanism 116 as seen in FIGS. 2 and 3, which is also molded from insulating material, preferably a rigid plastic such as nylon. The latching mechanism 116 includes two legs 118 and 120 having latching teeth 122 at one end and a thumb press 124 at the other end.

The legs 118 and 120 are unitary and formed as a one piece unitary member with the first connector 6 and are coupled to the first connector 6 on its second and fourth sides 61 and 63 at pivot joints 126. The pivot joints 126 are located between the ends of the legs 118 and 120, preferably closer to the end having the thumb press 124.

The legs 118 and 120 extend parallel to each other and parallel to the second and fourth sides 61 and 63 of the first connector 6, past the second end 22 of the first connector 11 the same distance as the length of the second connector's arms 106 and 107. The legs 118 and 120 are spaced from the sides 61 and 63 of the first connector 6, the same distance as the width of the second connector's arms 106 and 107. When the first and second connectors 6 and 11 are coupled together as seen in FIG. 3, the latching teeth 122 engage shoulders 110 and 111, thereby locking the connectors 6 and 11 together.

Assembly

Figure 10:
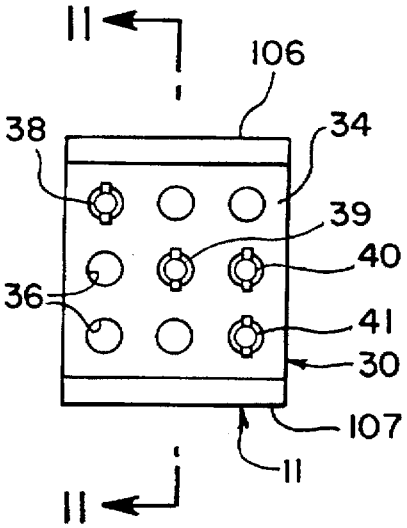
FIG. 10 is a front end view of the second connector of FIGS. 1–7.

As seen in FIGS. 3, 8 and 10, female terminals 25–28 having wires 7–10 fixedly coupled thereto, are inserted into the first set of apertures or bores 24 having the fourth through seventh positions, and through first large diameter 70 of first end 20. Line terminal 28, having line wire 7 fixedly coupled thereto, is inserted into the first set of apertures 24 at the seventh position, i.e., bottom, left hand corner of connector 6 as seen in FIG. 8. Terminals 25, 26 and 27, having first, second and third wires 8, 9 and 10 fixedly coupled thereto, are inserted into the first set of apertures or bores 24 at the fourth, fifth and sixth positions, respectively.

As the terminals 25–28 are being inserted and reach the small diameters 72 of bores 24, the legs 82 collapse against their bodies 80, thereby allowing the terminals 25–28 to fit through the small diameters 72 of bores 24. When the terminals 25–28 reach the second large diameters 74 of bores 24, the legs 82 deflect and resiliently pivot outwardly to their original position and engage the shoulders 78 of bores, thereby preventing the wires 7–10 from being pulled out through the first end 20 of first connector 6. The connecting bands 54 engage the stops 76, thereby preventing the wires 7–10 from being pushed out through the second end 22 of first connector 6. Thus, the wires 7–10 become fixedly coupled within the apertures or bores 24 at the positions discussed above.

As seen in FIGS. 1, 7 and 9, contact pins 38–41 having wires 12–15 fixedly coupled thereto are inserted into the second connector 11 through the large diameter 71 of first opposing face 32. Contact pins 38–41 are inserted into the second set of apertures or bores 36 at the first, fifth, sixth and ninth positions (assuming the second connector 11 is in the first orientation).

Specifically, the 120 volt pin 41 is inserted at the ninth position, and the 277 volt pin 38 is inserted at the first position. The second and third pins 39 and 40, which are connected to the wires 14 and 13, are inserted at the fifth and sixth positions, respectively.

When the pins 38–41 reach the small diameter sections 73, the legs 104 collapse, allowing the pins 38–41 and wires 12–15 to pass through the small diameter sections 73 of bores 36. After the pins 38–41 pass through the small diameter sections 73 of bores 36 and out past the second opposing face 34 of the main body 30, the legs deflect and resiliently pivot outwardly to their original position and engage second opposing face 34.

As discussed above in connection with second connector 11, legs 104 prevent pins 38–41 from being pulled back through the apertures or bores 36 and out the first face 32. Similarly, connecting bands 105 prevent pins 38–41 from being pulled through the main body 30 out the second opposing face 34. Thus, pins 38–41 are fixedly coupled within the apertures or bores 36 at the first, fifth, sixth and ninth positions.

To couple the connectors 6 and 11 together, the thumb presses 124 are depressed toward the first connector 6 as seen in FIG. 4, thereby pivoting the latching teeth 122 outwardly away from the first connector 6. With the second connector 11 in the first orientation as seen in FIGS. 3–5, the contact pins 38–41 on the second connector 11 are axially inserted into the first connector's apertures or bores 24.

Specifically, the high voltage pin 38 is inserted within the first set of apertures or bores 24 at the third position. The third position of the first connector 6 has no terminal inserted therein, so no connection is made. Contact pin 39 is inserted into apertures or bores 24 at the fourth position, and electrically engages the first terminal 25 which is connected to junction box wire 8. Pin 40 is inserted into aperture or bore 24 located at the fifth position, and thus electrically engages second terminal 26 which is connected to lamp wire 9. Low voltage pin 41 is inserted into the aperture or bore 24 located at the seventh position, and thus engages line terminal 28, which is coupled to line wire 7.

After the connectors 6 and 11 are coupled in this way, the latching mechanism 116 is released. Upon release, legs 118 and 120 on the first connector pivotally deflect to their original position with latching teeth 122 engaging shoulders 110 and 111 on the second connector, thereby securely coupling first and second connectors 6 and 11 together as in FIG. 5. Likewise, connectors 6 and 11 can be unconnected by depressing the thumb presses 124, as shown in FIG. 4, thereby disengaging latching teeth 122 from shoulders 110 and 111 and allowing connectors 6 and 11 to be axially separated.

As seen in FIGS. 6 and 7, second connector 11 can be pivoted or rotated 180° to the second orientation and reinserted into the first connector 6 to obtain the higher voltage.

When first and second connectors 6 and 11 are coupled together with the second connector 11 in the second orientation as seen in FIGS. 6 and 7, low voltage pin 41 is inserted into the aperture or bore 24 located at the third position, which does not have a terminal coupled therein, and thus, no electrical connection is made. Pin 39 is inserted into the aperture or bore 24 located at the sixth position, and thus engages third terminal 27, which is connected to junction box wire 10. Pin 40 is inserted into the aperture or bore 24 located at the fifth position, wherein second terminal 26 is fixedly coupled and connected to lamp wire 9. High voltage pin 38 is inserted within the aperture or bore 24 located at the seventh position, wherein line terminal 28 is fixedly coupled and connected to line wire 7.

The same process can be repeated if the lower voltage is again desired.

While the preferred embodiment has been chosen to illustrate the invention, it will be understood by those skilled in the art that various changes and modifications can be made therein without departing from the scope of the invention as defined in the appended claims. For example, while first connector 6 is shown with cylindrical female electrical terminals and second connector 11 is shown with pin-shaped male electrical terminals, this could be reversed.

What is claimed is:

1. An electrical assembly, comprising:

a lamp fixture with a pair of lamp terminals;

a dual voltage ballast electrically coupled to said lamp fixture, said ballast having a high voltage terminal, a low voltage terminal and a lamp wire terminal;

a first connector having first and second opposing ends with a plurality of first electrical terminals, one of said first terminals being electrically connected to a hot conductor of a power cable by a line wire, another of said first terminals being electrically connected to a neutral conductor of a power cable by a common wire and another of said first terminals being electrically connected to one of said lamp terminals of said lamp fixture by a first lamp wire; and a second connector having a main body with first and second opposing faces with a plurality of second electrical terminals, one of said second terminals being electrically connected to said low voltage terminal of said ballast by a low input voltage wire, another of said second terminals being electrically connected to said high voltage terminal of said ballast by a high input voltage wire and another of said second terminals being electrically connected to said lamp wire terminal of said ballast by a second lamp wire, said first and second connectors adapted to be positioned in first and second orientations, said second terminal with said low input voltage wire being electrically coupled to said first terminal with said line wire when said first and second connectors are in said first orientation, and said second terminal with said high input voltage wire being electrically coupled to said first terminal with said line wire when said first and second connectors are in said second orientation, said first and second connectors being rotatable relative to one another through 180° to move between said first and second orientations.

2. An electrical assembly as claimed in claim 1, wherein said first connector includes indicia on the side of said first connector directly adjacent and aligned with said first terminal connected to said line wire; and said second connector includes indicia on the sides of said second connector directly adjacent and aligned with said second terminals connected to said high and low voltage wires.

3. An electrical assembly as claimed in claim 1, and further comprising a latch member for securing said first and second connectors together in said first and second orientations.

4. An electrical assembly as claimed in claim 1, wherein said second connector includes arms integrally coupled to and extending from opposing sides of said second connector parallel to said terminals and past said second face.

5. An electrical assembly as claimed in claim 4, wherein each of said arms form a shoulder.

6. An electrical assembly as claimed in claim 5, wherein a portion of said first connector slidably fits between said arms when said first and second connectors are connected.

7. An electrical assembly as claimed in claim 1, wherein said first connector includes a first set of apertures forming a first matrix at said second end, with said first terminals positioned within said first set of apertures, said first matrix has three rows and three columns to form a three by three matrix, a first row of said first matrix has first, second and third positions, a second row of said first matrix has fourth, fifth and sixth positions, and a third row of said first matrix has seventh, eighth and ninth positions, and said second connector includes second set of apertures forming a second matrix at said second face, with said second terminals positioned within said second set of apertures, said second matrix has three rows and three columns to form a three by three matrix, a first row of said second matrix has first, second and third positions, a second row of said second matrix has fourth, fifth and sixth positions, and a third row of said second matrix has seventh, eighth and ninth positions.

8. An electrical assembly as claimed in claim 7, wherein said first terminal connected to said line wire is coupled within said seventh position of said first matrix.

9. An electrical assembly as claimed in claim 8, wherein said second terminal connected to said low voltage wire is coupled within said ninth position of said second matrix, and said second terminal connected to said high voltage wire is coupled within said first position of said second matrix.

10. An electrical assembly as claimed in claim 1, and further comprising a pair of latching members for securing said first and second connectors together, said latching members being resiliently, pivotally and integrally coupled to opposing sides of said first connector and extending outwardly past said second end.

11. An electrical assembly as claimed in claim 10, wherein said latching members have locking teeth for engaging shoulders formed on said second connector, thereby latching said first connector to said second connector.

12. An electrical assembly as claimed in claim 11, wherein said connectors are molded and formed of rigid plastic.

* * * * *